US005110672A

United States Patent [19]

Zehle et al.

[11] Patent Number: 5,110,672

[45] Date of Patent: May 5, 1992

[54] PAPERMAKERS' PRESS FELT WITH BASE FABRIC THAT DOES NOT REQUIRE SEAMING

[75] Inventors: Wilhelm Zehle; Hippolit Gstrein, both of Gloggnitz, Austria

[73] Assignee: Huyck Corporation, Wake Forest, N.C.

[21] Appl. No.: 717,629

[22] Filed: Jun. 19, 1991

[51] Int. Cl.[5] ..... B32B 5/02

[52] U.S. Cl. ..... 428/234; 139/383 AA; 428/222; 428/223; 428/280; 428/300

[58] Field of Search ..... 428/280, 234, 222, 223, 428/300; 139/383 AA

[56] References Cited

U.S. PATENT DOCUMENTS

| | | | |
|---|---|---|---|
| 4,755,260 | 7/1988 | Sakuma | 428/300 |
| 4,863,786 | 9/1989 | Green et al. | 428/234 |
| 4,939,025 | 7/1990 | Nicholas et al. | 428/300 |
| 5,041,332 | 8/1991 | Lasinsky | 428/280 |

*Primary Examiner*—James J. Bell

*Attorney, Agent, or Firm*—Lorusso & Loud

[57] ABSTRACT

An improved papermakers' press felt and a method to make such an improved press felt, for use in papermaking, cellulose and similar machines, including a base fabric assembly joined without seaming. In one embodiment, the ends of the base fabric are joined to create an endless fabric by a needling operation that also entangles the batt into the base fabric. The ends to be joined to the flat-woven base fabric are preferably cut on a diagonal. To produce this fabric, a flat-woven base fabric is cut to the proper dimensions for a press felt and rolled into two continuous loops, one inside the other, to form the base fabric assembly. Alternatively, two flat-woven base fabrics of the appropriate size for a press felt are used. Each fabric is rolled once to form a loop and the two loops are assembled, one within the other, to form the base fabric assembly. In a second embodiment, the base fabric is joined prior to needling by a pintle cable inserted through loops formed when a void is formed in the fabric to accommodate the pintle cable.

25 Claims, 2 Drawing Sheets

PAPERMAKERS' PRESS FELT WITH BASE FABRIC THAT DOES NOT REQUIRE SEAMING

BACKGROUND OF THE INVENTION

This invention relates to papermakers' felts and especially to needled press felts with a woven base fabric that does not require seaming into which is needled a batt consisting of wool or synthetic fibers.

In the conventional papermaking process, a water slurry or suspension of cellulose fibers, known as the paper "stock", is fed onto the top of the upper run of a traveling endless forming belt. The forming belt provides a papermaking surface and operates as a filter to separate the cellulosic fibers from the aqueous medium to form a wet paper web. In forming the paper web, the forming belt serves as a filter element to separate the aqueous medium from the cellulosic fibers by providing for the drainage of the aqueous medium through its mesh openings, also known as drainage holes, by vacuum means or the like located on the drainage side of the fabric.

After leaving the forming medium, the somewhat self-supporting paper web is transferred to the press section in the machine and onto a press felt, where still more of its water content is removed by passing it through a series of pressure nips formed by cooperating press rolls, these press rolls serving to compact the web as well. It is this press felt that is the subject of the present invention.

Subsequently, the paper web is transferred to a dryer section where it is passed about and held in heat transfer relation with a series of heated generally cylindrical rolls to remove still further amounts of water therefrom.

The base fabrics for the press felts described above can be produced either flat woven and joined or they can be woven endless. A flat woven base fabric must be removed from the weaving machine and joined by seaming. Flat-woven base fabrics will have a tendency to have a different thickness in the joining area where it is seamed than in the remainder of the fabric. Joining a flat-woven base fabric is labor intensive and therefore also expensive. Conversely, in an endless woven fabric, the loom edges tend to have a different thickness than the body of the fabric. Forming the base fabric endless requires a long time in the loom which is, of course, expensive. These non-uniformities in thickness have been known to cause vibrations and bouncing of the press rolls on the paper machine as the thicker part of the felt passes through the press section.

In recent years the speed of papermaking operations have increased to the point that greater roll pressures have been necessitated which cause an increase in the tendency of felts to mark the sheets of paper as they pass through the nip and to wear excessively as they pass over the machine rolls, suction boxes, and cleaning equipment. The problems resulting from the increased production requirements vary depending upon the conditions under which the papermaking operation takes place (temperature, humidity, etc.), the number of abrasive surfaces over which the felt travels, the condition of the papermaking machinery and various other factors known to persons skilled in the art.

Ideally, press felts should have at least the following properties. First, they should have a top surface that is fine enough to produce a smooth finish and minimize marking of the sheet of paper being produced. Second, they should be open enough to allow water to drain through without significant impedance. Third, they should be resilient enough to quickly recover from repeated high nip pressures over a long period of time. Fourth, they should be tough and strong enough to provide good stability, wear resistance and felt life.

Felts with a base fabric assembly having two or more layers of woven fabric, one on top of the other, have been introduced by a number of felt makers. Such woven base fabric can be of either a so-called "duplex" or "triex" construction. Both terms are well known in the art. In felts having a base fabric assembly with two or more layers of woven fabric, the top layer can be woven fine to prevent marking from the coarser machine side bottom layer and to provide good retention of the needled fibers. Also the top woven fabric can be made more compressible than the bottom layer. The other layer, the bottom base fabric layer, can be made relatively coarse so that it has a high void volume and a high degree of compaction resistance and wear resistance. The term "void volume" refers to the empty air space in a woven construction under compression which does not collapse when the fabric is compressed. This volume will receive water expressed during the papermaking process so that the water will not run out or go back into the paper. Void volume in a base fabric is maximized when the yarn is more incompressible and has a larger diameter.

Generally, press felts are assembled in the following manner. If the fabrics are not woven endless, the ends are joined by stitching a seam in a conventional manner. The base fabric is then installed on a needle loom, with the fine layer comprising the outside or top loop where multilayer base fabrics are employed. Batt fibers are applied to the top side or paper contacting surface, in sufficient quantity and weight to give good bulk and cushion properties. The fibers are anchored to the base fabric assembly by one or more needling operations. Thus, the surface of the press felt (top) which contacts the paper web is a felt, formed as the batting material fibers are needled to the base fabric. Fibers may also be needled to the bottom of the woven base fabric to ensure good anchoring of the fibers on the top side.

All press felts whether woven endless or joined by seaming after weaving with either single or double layer construction, contribute significantly to the aforementioned vibration problems in the papermaking process because of the varying thicknesses throughout the body of the press felt.

Accordingly, it is an object of the present invention to provide a less expensive method to prepare an endless press felt for a papermaking or similar machine.

It is a further object of the present invention to provide a more efficient method for joining the woven fabric of the base fabric assembly of a press felt for a papermaking or similar machine.

Another object of the present invention is to provide a method to produce a joined press felt for a papermaking or similar machine which distributes impact of the press rolls from the papermaking machine over a greater area of the press felt.

A further object of the present invention is to provide an improved press felt for the press section of a papermaking machine or similar machine.

It is also a further object of the present invention to provide an improved base fabric construction for a press felt in a papermaking machine.

Still another object of the presen invention is to provide an improved method for making a dual base fabric needled press felt for the press section of a papermaking machine.

It is a further object of the present invention to provide a felt with an improved base fabric construction having uniform thickness so as to significantly reduce or eliminate vibration of the press rolls on the papermaking machine.

SUMMARY OF THE INVENTION

In accordance with the present invention, there is provided an improved papermakers' press felt, for use in papermaking, cellulose and similar machines, including a base fabric assembly formed from one or more pieces of flat-woven base fabric and one or more layers of batting material. The base fabric is joined without seaming. In one embodiment, the needling operation consolidates the components of the felt and joins the ends of the base fabric in the needle loom in a one step process. The ends of the flat-woven base fabric are preferably cut on a diagonal. In another embodiment, the base fabric is joined with a pintle cable prior to the needling operation.

The base assembly may include a single flat-woven base fabric made into two complete layers by forming a spiral from the single base fabric. Alternatively, the base assembly includes two flat-woven base fabrics which are each rolled to form two loops and the loops are assembled one within the other and joined with the cable or needling process.

These and other objects of the present invention will become apparent to those skilled in the art from a reading of the ensuing description in conjunction with the accompanying drawing, in which like reference numerals refer to like members in the various figures.

DETAILED DESCRIPTION OF THE INVENTION

Figure 1:
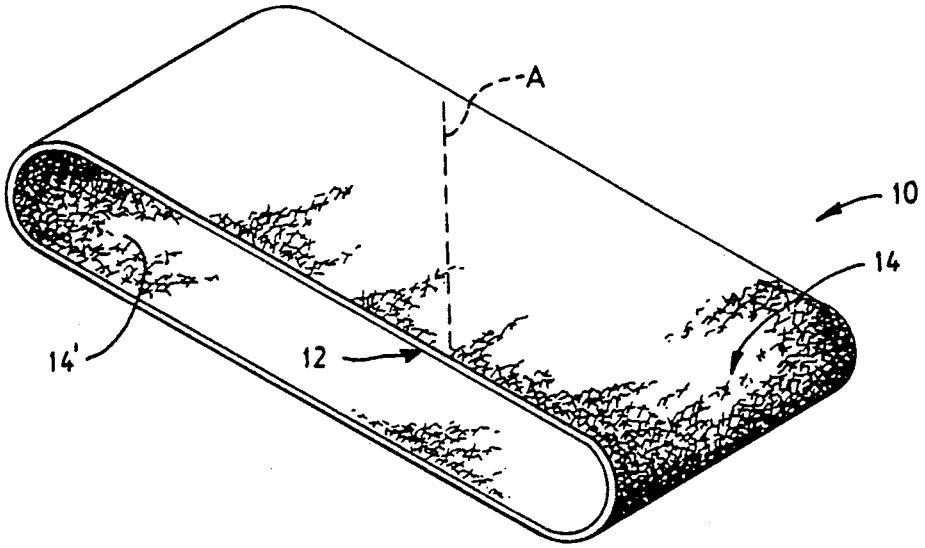
FIG. 1 is a perspective view of the endless press felt formed according to the method of the present invention.

The felt of the present invention, as shown in FIG. 1, comprises a needled press felt 10 with a base fabric assembly 12 and one or more layers of batting material 14, 14'. The base fabric assembly 12 includes at least one base fabric configured to provide a multilayer base fabric assembly.

The fabric which makes up the base fabric assembly can be chosen for the qualities desired in the finished press felt. The fabric can be a single layer, dual layer or triple layer fabric. The term "single layer" as used herein refers to a fabric comprising one set of machine direction yarns and one set of cross machine direction yarns. "Dual layer" refers to a fabric comprising two sets of cross machine direction yarns and one set of machine direction yarns interweaving them. Such fabrics are also known as "duplex" fabrics. By the term "triple layer" or "triex" is meant a fabric comprising two complete weaves. Each weave includes one set of machine direction yarns and one set of cross machine direction yarns. A thread or threads interweaves the two weaves to produce the triple layer fabric. The yarns making up the base fabric will be those known in the art. For example, the yarns may be spun yarns, monofilaments yarns, multifilament yarns or even monofilament or multifilament twist yarns. The yarns may be produced from wool, cotton, polyolefins, polyamides, polyesters, mixtures thereof and the like.

Needling the entire structure gives the felt a uniform thickness. Needling also provides a cushioned absorbency to the felt and distributes the pressure uniformly across the width of the felt for efficient water removal. Both uniform thickness and pressure distribution significantly reduce or eliminate vibration of the press polls of the papermaking machine. Needling is necessary to compress the felts to a given density and resiliency and to entangle the fibers in the base fabric so they do not come loose during the papermaking operation. The batt material may be made up of fibers of any of a number of well known compositions, including natural fibers such as wool, but preferably will be made in whole or in part from synthetic materials such as nylon, dacron, etc. In this connection, it is desirable that these fibers be relatively coarse or of large diameter. In the practice of this invention, these fibers advantageously are 40 microns or larger in diameter, to provide large intersticial areas as hereinafter described. They will be selected for their stiffness, or "rigidity"; that is, their tendency to resist bending or deformation at fiber cross-over points since this enhances their ability to produce a good papermaking surface.

In one embodiment of the present invention, the base fabric is joined at the same time the felt is prepared by needling. In the embodiment shown in FIGS. 2 and 3, a flat-woven base fabric 15 is cut to the proper dimensions for a press felt. The flat-woven fabric 15 is rolled into a spiral to form two continuous complete loops, one loop inside the other, and the ends 17 are loosely stitched together to form a double layer of fabric which is the base assembly 12 shown clearly in FIG. 3. To join the fabric 15, the ends 17 of the fabric 15 are aligned very closely and stitched together with a brittle yarn that in subsequent needling operations will be completely destroyed. This assembly 12 is then placed in a needle loom and needled together with the batting material 14 in a conventional manner to form a needled press felt with a double base fabric.

Figure 4:
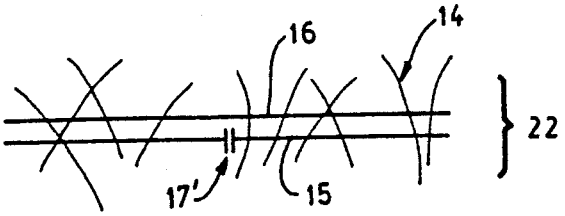
FIG. 4 is a diagrammatic cross section view of a portion of the press felt of another embodiment of the present invention.
Figure 5:
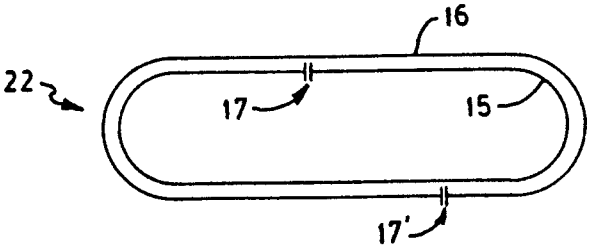
FIG. 5 is a diagrammatic cross section view of the double layer base fabric assembly of the embodiment of the present invention shown in FIG. 4.

Alternatively, as shown in FIGS. 4 and 5, two flat-woven base fabrics 15 and 16 are cut to the proper dimensions for a press felt and each is rolled once to form a loop. The two fabric loops are assembled, one within the other; this forms the base assembly 22 shown best in FIG. 5. Cut ends 17 and 17' on each of the two fabrics are aligned very closely and stitched together with brittle yarns which are subsequently destroyed in later needling operations. The base assembly 22 is then placed in the needle loom with batting material 14 and needled in a conventional manner to produce a needled press felt with a multilayer base fabric. As described above, the characteristics of the individual base fabrics 15 and 16 may be selected to enhance the quality of the paper produced on the felt. It is within the skill of those knowledgeable in the relevant art to select the fabrics 15 and 16 for that purpose.

The advantages of the embodiment shown in FIGS. 4 and 5 is that two base fabrics with different characteristics can be used. A coarse base fabric with high void volume and a high degree of compaction resistance is desirable for the inside or wear surface of the press felt which contacts the machine and rollers. A finer fabric for the side of the press felt which faces the paper sheet will provide uniform pressure and prevent marking from the coarse machine side base fabric which reduces the quality of the paper sheet. The batting material is preferably comparatively thick and has a weight on the order of one-half ounce per square foot, but the amount and weight thereof may be varied to suit different operating conditions and purposes. The batt material, as noted above, is preferably formed of fibers of a relatively fine grade of synthetic material for purposes of increased bonding strength. Of course, wool fibers may be used. Such details are well within the skill of those in this art.

The two fabrics are rolled to form loops and assembled with the loop of coarser fabric inside the loop of fine fabric. Thus, the coarse fabric provides the wear surface which contacts the machine rollers. The batting material is positioned on the outside surface of the base fabric assembly adjacent the finer fabric and the entire structure is needled together to form a press felt having a continuous surface layer batting needled to a double base fabric construction. Also during the needling process, the individual fabrics constituting the base assembly are joined and the ends of the fabric are locked into position where they join. The two fabrics may be joined by a thread or threads interweaving them prior to the needling operation, but it is preferred that they are not joined together in a conventional manner prior to the needling operation. The top, fine layer of base fabric 16 is preferably a single layer plain weave monofilament fabric. The inside, coarse layer of base fabric 15 would preferably be a coarse weave fabric to provide maximum void volume and load-bearing capability.

A batt layer may be utilized as a roll contacting batt as well as a paper contacting batt, as shown in FIG. 1. In such a case, the batt layer provides a protection layer between the hard steel rolls and the base layer so that the rolls will not wear away the base layer as quickly as they would wear it away without the protective layer. Furthermore, a needled batt layer inside the belt, shown at 14 in FIG. 1, serves to lock the fibers in the top layer to the fabric and, of course, is helpful in joining the ends together.

Figure 2:
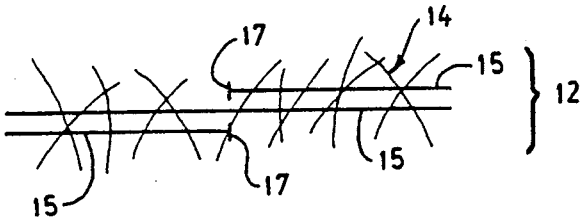
FIG. 2 is a diagrammatic cross section view of a portion of the press felt of one embodiment of the present invention.
Figure 3:
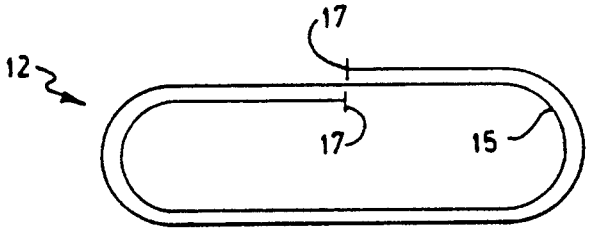
FIG. 3 is a diagrammatic cross section view of the double layer base fabric assembly of the embodiment of the present invention shown in FIG. 2.
Figure 6:
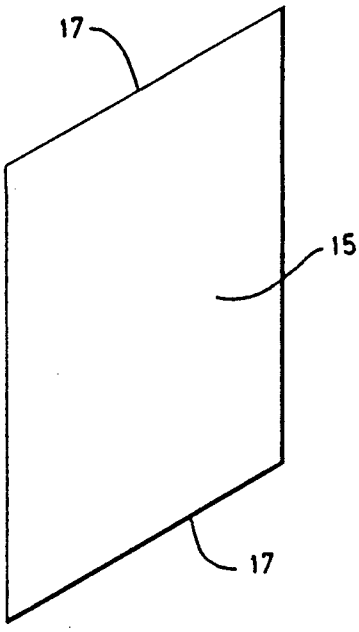
FIG. 6 is a perspective view of a flat-woven base fabric of the base assembly of the press felt of the present invention, having the preferred diagonal cut ends.

With the embodiments shown in FIGS. 2 and 4, the base fabric ends are preferably spliced or cut on the diagonal, as shown in FIG. 6, rather than a straight cut, the line of the angle of the ends forming an acute angle of 30° to 60° with the longitudinal edge of the felt. The dotted line marked "A" in FIG. 1 and reference number 17 in FIG. 6 illustrates the diagonal cut ends to the fabric edges. With the base fabric cut this way, it takes more time for a seam formed when the ends are joined to pass through the press nip. In this manner, the impact of the seams hitting the nip is spread and vibrations of the press rolls are lessened.

Figure 7A:
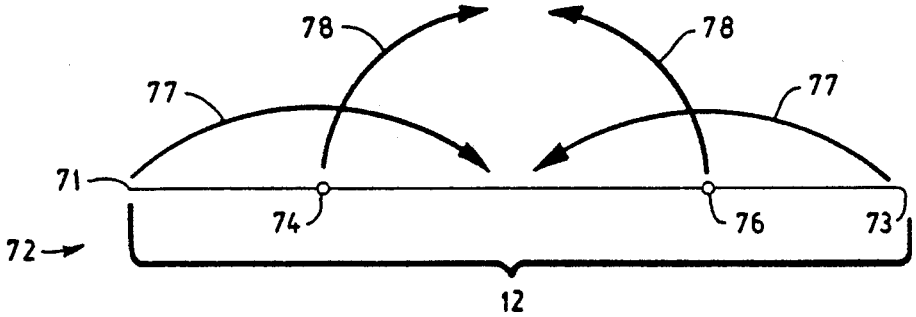
FIGS. 7A–7C provide a diagrammatic representation of the joining of a single layer base fabric according to another embodiment of the present invention.
Figure 7B:
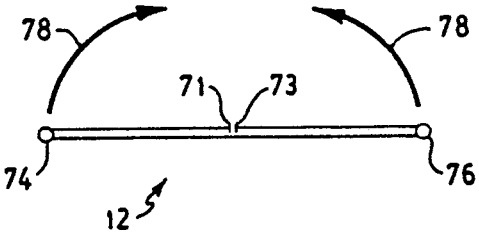
Figure 7C:
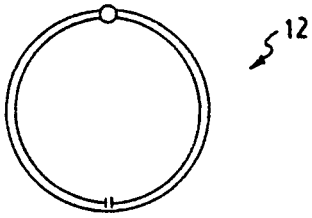

In a further embodiment of the present invention, the base fabric is joined, after looping, with a pintle cable to form a multilayer base fabric assembly prior to needling the felt together. In accordance with this embodiment of the present invention, the base fabric assembly will include a flat or endless woven base fabric. As shown in FIG. 7A, a flat base fabric 72 is formed and laid out. The fabric 72 is divided into four sections. Thus, the section being formed by the marks 74, 76 represents approximately one quarter of the fabric. A cross machine direction yarn is removed at the points 74 and 76 to form a void space 74, 76, which is intended to be used as a loop. The fabric ends are then folded in the direction of arrows 77 to form the fabric shown in FIG. 7B and the ends of the fabric 71, 73 ar stitched together loosely with brittle yarns which are subsequently destroyed in the needling operation. Points 74 and 76 are then folded in the direction of arrows 78 to form a circle. The loops at 74, 76 are intermeshed and a pintle cable is inserted to join the fabric into an endless base fabric, shown in FIG. 7C. The fabric, which is now a double layer fabric, is needled and finished as described above.

Figure 8A:
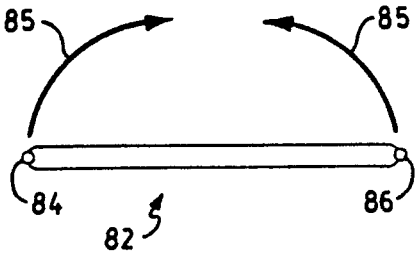
FIGS. 8A–8B provide a diagrammatic representation of the joining of an endless base fabric to form a multilayer base fabric according to yet another embodiment of the present invention.
Figure 8B:
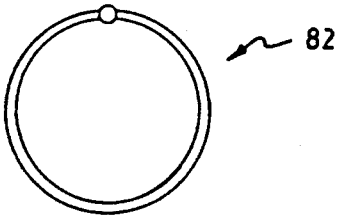

Alternatively, the base fabric assembly may be formed from, as shown in FIGS. 8A–8B, an endless base fabric. The endless fabric 82 is formed into an oval shape and a cross machine direction yarn is removed at each end to form a void space 84, 86 intended to be used as a loop. Points 84 and 86 are then folded in the direction of arrows 85 to form a circle, the loops 84, 86 are intermeshed, and a pintle cable is inserted to join the fabric into a multilayer base fabric 82 as shown in FIG. 8B. The fabric is now covered with a batting material, and needled and finished in a conventional manner.

The advantage to a base fabric prepared according to the embodiments of the present invention shown in FIGS. 7A–7C and 8A"8B is that in the area of the seaming of the base fabric, the thickness of the base fabric is not increased from the pintle cable joining because a yarn has been removed from that area already. Thus, the tendency of the press rolls to vibrate and bounce is decreased. The papermaking can proceed without excessive marking and wear.

With any of the fabrics and embodiments of the present invention, the labor intensive and expensive process of seaming the ends of a flat woven fabric is avoided. For endless woven fabrics, the variations in thickness at the loom edges is avoided. By needling a fabric of the present invention, the fabric ends will be joined, the prominence of the area that had normally been seamed is reduced, and the tendency of the press rolls to vibrate and bounce is decreased.

The invention may be embodied in other specific forms without departing from the spirit or essential characteristics thereof. For example, various types of needling procedures would produce press felts having different characteristics and usages. The present embodiments are therefore to be considered in all respects as illustrative and not restrictive, the scope of the invention being indicated by the appended claims rather than by the foregoing description, and there is no intention to exclude any equivalents thereof. Hence, it is recognized that various modifications are possible within the scope of the present invention as claimed.

What is claimed is:

1. An endless press felt for use in papermaking, cellulose and similar machines comprising:

a continuous loop of base fabric comprising at least two layers of base fabric material; and at least one layer of batt material needled to said continuous loop base fabric to provide a paper contact surface;

the ends of the fabric of the base fabric material being joined together solely by the needled batt material.

2. The endless press felt of claim 1 wherein the continuous loop of base material is formed from a single, continuous strip of fabric which is rolled into a spiral to form at least two complete loops, one within the other, before its ends are placed together and joined by needling.

3. The endless press felt of claim 2 further comprising a second layer of batt fabric needled to a side of said continuous loop of base fabric, opposite to the side of said continuous loop of base fabric to which the at least one layer of batt material is needled, to provide the wear surface of the press felt.

4. The endless press felt of claim 2 wherein the ends of the flat-woven fabric have a diagonal cut.

5. The endless press felt of claim 1 wherein the continuous loop of base fabric is formed from two flat-woven base fabrics which are each rolled once to form a loop, and assembled one within the other to form a single two-layered loop.

6. The endless press felt of claim 5 wherein the two flat-woven base fabrics are of different materials.

7. The endless press felt of claim 6 wherein the base fabric of the outside loop is made of relatively thin or fine yarns and the base fabric of the inside loop is made of relatively coarse and incompressible yarns.

8. The endless press felt of claim 5 wherein the fabrics of the base material have ends with a diagonal cut.

9. The endless press felt of claim 5 further comprising a second layer of batt fabric needled to a side of said continuous loop of base fabric, opposite to the side of said continuous loop of base fabric to which the at least one layer of batt material is needled, to provide the wear surface of the press felt.

10. An endless press felt for use in papermaking, cellulose and similar machines and comprising a continuous loop of base fabric, said continuous loop formed from a flat woven base fabric of interwoven machine direction yarns and cross machine direction yarns said flat woven base fabric having a cross machine direction yarn removed at a distance from each end to form a void, and the fabric folded at the void to provide loops at each end, the loops on each end intermeshed and a pintle cable inserted therethrough to join the fabric into said continuous loop at least one layer of batt material needled to said continuous loop to provide a paper contact surface.

11. The endless press felt of claim 10 further comprising a second layer of batt material needled to the press felt on a side of said press felt opposite to the side to which said at least one layer of batt material is needled to provide a wear surface.

12. An endless press felt for use in papermaking, cellulose and similar machines comprising:

a continuous loop of base fabric said continuous loop formed from an endless woven base fabric of interwoven machine direction yarns and cross machine yarns, said endless woven base fabric having a cross machine direction yarn removed from each end to form a void and the fabric folded at the void to provide loops at each end, the loops being intermeshed and a pintle cable inserted there through to join the fabric into said continuous loop;

at least one layer of batt material needled to said continuous loop to provide a paper contact surface.

13. The endless press felt of claim 12 further comprising a second layer of batt material needled to the press felt on a side of said press felt opposite to the side to which said at least one layer of batt material is needled to provide a wear surface.

14. A method for producing an endless press felt for use in papermaking, cellulose and similar machines comprising:

forming a continuous loop of base fabric by rolling a single continuous strip of a flat-woven base fabric into a spiral to form at least two complete loops, one within the other, the ends of the base fabric adjacent;

applying a layer of batt fibers to the outside, paper contacting side of the continuous loop of base fabric; and needling the structure formed as a result of the aforementioned steps, the ends of the fabric of the base material being joined together solely by the needling process.

15. The method of claim 14 further comprising cutting the ends of the flat-woven base fabric in a diagonal cut prior to positioning them adjacent.

16. The method of claim 14 further comprising the step of applying a second layer of batt fibers to the inside, machine contacting side of the continuous loop of base fabric prior to said needling step.

17. A method for producing an endless press felt for use in papermaking, cellulose and similar machines comprising:

rolling a flat-woven base fabric to form a loop, the ends of the fabric adjacent;

rolling a second layer of flat-woven base fabric to form a second loop, the ends of the second layer adjacent;

assembling the loop and second loop within each other to form a single, two-layered loop of base fabric;

applying a layer of batt fibers to the top, paper contacting side of the two-layered loop of base fabric; and needling the structure formed as a result of the aforementioned steps; the ends of the base fabric and second base fabric being joined together solely by the needling process.

18. The method of claim 17 wherein the base fabric and second base fabric are of two different materials.

19. The method of claim 18 wherein the base fabric comprising the top paper contacting side of the two-layered loop is made of relatively thin or fine yarns and the base fabric comprising the bottom machine contacting side of the two-layered loop is made of relatively coarse and incompressible yarns.

20. The method of claim 17 further comprising cutting the ends of the flat-woven fabrics with a diagonal cut prior to placing the ends adjacent.

21. The method of claim 18 further comprising the step of applying a second layer of batt fibers to the bottom, machine contacting side of the two-layered loop of base fabric prior to said needling step.

22. A method for producing an endless press felt for use in papermaking, cellulose and similar machines comprising:

providing a flat-woven base fabric of interwoven machine direction and cross machine direction yarns;

removing a cross machine direction yarn a distance from each end of the flat-woven fabric to form a void;

folding the flat-woven base fabric at the void on each end to form a double layer of base fabric material with loops at each end;

joining the fabric by intermeshing the loops and inserting a pintle cable through the loops to form an endless base fabric;

applying a layer of batt fibers to the outside, paper contacting side of the endless base fabric; and needling the structure formed as a result of the aforementioned steps.

23. The method of claim 22 further comprising the step of applying a second layer of batt fibers to the inside, machine contacting side of the endless base fabric prior to said needling step.

24. A method for producing an endless press felt for use in papermaking, cellulose and similar machines comprising:

providing an endless woven base fabric of interwoven machine direction and cross machine direction yarns;

removing a cross machine direction yarn from each end of the fabric to form a void;

folding the fabric at the adjacent void so as to place the void on each end;

inserting a pintle cable through the adjacent voids to form a multilayer endless base fabric;

applying a layer of batt fibers to the outside, paper contacting side of the endless base fabric; and needling the structure formed as a result of the aforementioned steps.

25. The method of claim 24 further comprising the step of applying a second layer of batt fibers to the inside, machine contacting side of the endless base fabric prior to said needling step.

* * * * *